US012422139B2

(12) United States Patent
Safar et al.

(10) Patent No.: US 12,422,139 B2
(45) Date of Patent: Sep. 23, 2025

(54) OPTIMIZING PURGE GAS FLOWS THROUGH A FLARE GAS NETWORK

(71) Applicant: Saudi Arabian Oil Company, Dhahran (SA)

(72) Inventors: Anas H. Safar, Dhahran (SA); Yousef D. Aloufi, Dhahran (SA); Abdullmajeed I. Al Sanad, Dhahran (SA); Mohammed A. Almubayedh, Dhahran (SA); Ayman A. Alabdullatif, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 85 days.

(21) Appl. No.: 18/404,437

(22) Filed: Jan. 4, 2024

(65) Prior Publication Data

US 2025/0224111 A1 Jul. 10, 2025

(51) Int. Cl.
*F23G 7/08* (2006.01)
*F23G 5/50* (2006.01)

(52) U.S. Cl.
CPC ..... *F23G 7/08* (2013.01); *F23G 5/50* (2013.01)

(58) Field of Classification Search
None
See application file for complete search history.

(56) References Cited

U.S. PATENT DOCUMENTS 4,265,611 A 5/1981 Reed et al.
10,343,195 B2 7/2019 Daniel
11,747,315 B2 9/2023 Safar et al.
11,795,810 B2 10/2023 Safar et al.
2014/0266740 A1 9/2014 Fernandes et al.
2019/0242575 A1 8/2019 Fisher et al.
2023/0128460 A1 4/2023 Safar et al.
2024/0011632 A1 1/2024 Safar et al.
2024/0160184 A1 5/2024 Ghamdi et al.

FOREIGN PATENT DOCUMENTS

KR 20210121329 A 10/2021
WO WO2017218913 12/2017

OTHER PUBLICATIONS

U.S. Appl. No. 18/089,035, Safar et al., filed Dec. 27, 2022.
U.S. Appl. No. 18/483,961, Al-Blaies et al., filed Oct. 10, 2023.
International Search Report and Written Opinion in International Appln. No. PCT/US2025/010268, dated Mar. 26, 2025, 14 pages.

*Primary Examiner* — Jason Lau
(74) *Attorney, Agent, or Firm* — Fish & Richardson P.C.

(57) ABSTRACT

Techniques of processing a flare gas include operating a flare gas piping network to output a flare from a plurality of flows of a purge gas in purge gas headers coupled to a main header; and during operation of the flare gas network to output the flare from the plurality of flows of the purge gas: obtaining a fluid pressure of the flow of the purge gas at each purge gas header; obtaining a fluid temperature of the flow of the purge gas at each purge gas header; and obtaining a rate of the flow of the purge gas at each purge gas header; and based on the obtained fluid pressures, fluid temperatures, and rates of the flows of the purge gas, determining an optimized flow velocity of the purge gas at each of the plurality of purge gas headers.

20 Claims, 4 Drawing Sheets

300

302 304 306

| Manifold | Current Purge Gas Flaring (MMSCFD) | Optmized Purge Gas Flaring (MMSCFD) |
|---|---|---|
| 1 | 0.188 | 0.603 |
| 2 | 0.192 | 0.603 |
| 3 | 0.987 | 0.609 |
| 4 | 0.987 | 0.603 |
| 5 | 0.500 | 0.271 |
| 6 | 0.402 | 0.153 |
| 7 | 0.469 | 0.188 |
| Total | **3.725** | **3.030** |

FIG. 3

OPTIMIZING PURGE GAS FLOWS THROUGH A FLARE GAS NETWORK

TECHNICAL FIELD

This disclosure relates to systems and methods for optimizing purge gas flows through a flare gas network.

BACKGROUND

The production of hydrocarbons brings usable fluids, such as oil and gasses, from a subterranean formation. However, some produced fluids, such as acid gasses and other fluids (liquids and gasses, or mixed phase fluids) are not usable (or are not immediately usable). Some of these gasses, often called purge gasses, are released to the atmosphere through a flare gas network, which burns these gasses as flares.

SUMMARY

In an example implementation, a flare gas processing system includes a flare gas piping network that includes a main header fluidly coupled to a flare output; and a plurality of purge gas headers, with each of the purge gas headers fluidly coupled to the main header and configured to receive a flow of a purge gas. The system includes a pressure sensor coupled to each purge gas header and configured to measure a fluid pressure of the flow of the purge gas at each purge gas header; a temperature sensor coupled to each purge gas header and configured to measure a fluid temperature of the flow of the purge gas at each purge gas header; a flow measurement assembly coupled to each purge gas header and configured to measure a rate of the flow of the purge gas at each purge gas header; and a control system communicably coupled to the pressure sensors, the temperature sensors, and the flow measurement assemblies and configured to perform operations. The operations include during the flows of the purge gas through the plurality of purge gas headers, obtaining the fluid pressures, the fluid temperatures, and the rates of the flows of the purge gas; and based on the obtained fluid pressures, fluid temperatures, and rates of the flows of the purge gas, determining an optimized flow velocity of the purge gas at each of the plurality of purge gas headers.

In an aspect combinable with the example implementation, the operations include determining corrected rates of flow of the purge gas for the plurality of purge gas headers based on the obtained fluid pressures, the obtained fluid temperatures, and orifice sizes for the plurality of purge gas headers; and determining the optimized flow velocity of the purge gas at each of the plurality of purge gas headers based on the corrected rates of flow of the purge gas for the plurality of purge gas headers.

In another aspect combinable with any of the previous aspects, the operation of determining the optimized flow velocity of the purge gas at each of the plurality of purge gas headers includes obtaining a minimum flow velocity of each flow of the purge gas in the plurality of purge gas headers; obtaining a maximum flow velocity of each flow of the purge gas in the plurality of purge gas headers; calculating a flow velocity of each flow of the purge gas in the plurality of purge gas headers based on the corrected rates of flow of the purge gas for the plurality of purge gas headers and a pressure drop through each purge gas header and a size of each purge gas header; comparing the calculated flow velocity of each flow of the purge gas to the obtained minimum and maximum flow velocities of each flow of the purge gas; and based on the comparison, determining the optimized flow velocity of the purge gas at each of the plurality of purge gas headers.

In another aspect combinable with any of the previous aspects, determining the optimized flow velocity of the purge gas at each of the plurality of purge gas headers includes for each calculated flow velocity less than the minimum flow velocity of the flow of the purge gas in the purge gas header, determining the optimized flow velocity for the purge gas in the purge gas header that is between the minimum flow velocity and the maximum flow velocity; and for each calculated flow velocity greater than the maximum flow velocity of the flow of the purge gas in the purge gas header, determining the optimized flow velocity for the purge gas in the purge gas header that is between the minimum flow velocity and the maximum flow velocity.

Another aspect combinable with any of the previous aspects further includes a moisture sensor coupled to each purge gas header and configured to measure an amount of water in the flow of the purge gas at each purge gas header.

In another aspect combinable with any of the previous aspects, the operations include determining a composition of each flow of the purge gas at the plurality of purge gas headers; and determining an amount of condensate in each of the plurality of purge gas headers based at least in part on the determined composition of each flow of the purge gas and the measured amount of water in each flow of the purge gas.

In another aspect combinable with any of the previous aspects, the operations include determining a presence of one or more corrosive species in the determined composition of each flow of the purge gas at the plurality of purge gas headers; and based on the determined presence of one or more corrosive species, determining a estimated corrosion rate of the plurality of purge gas headers.

In another aspect combinable with any of the previous aspects, the one or more corrosive species includes at least one of carbon dioxide ($CO_2$), hydrogen sulfide ($H_2S$), or oxygen ($O_2$).

In another aspect combinable with any of the previous aspects, the operations include calculating, based on the composition of each flow of the purge gas at the plurality of purge gas headers, a mass flow rate balance of each flow of the purge gas; and determining, from the mass flow rate balance of each flow of the purge gas, molar flow rates of each component of each flow of the purge gas; and determining an acidity of each flow of the purge gas based on the molar flow rates of each component.

Another aspect combinable with any of the previous aspects further includes a plurality of valves, each valve coupled within a particular purge gas headers and configured to control the flow of the purge gas in the particular purge gas header.

In another aspect combinable with any of the previous aspects, the operations include controlling at least one valve to adjust the rate of flow of the purge gas in the particular purge gas header based on the optimized flow velocity of the purge gas in the particular purge gas header.

In another example implementation, a method of processing a flare gas includes operating a flare gas piping network to output a flare from a plurality of flows of a purge gas, where the flare gas piping network includes a main header fluidly coupled to a flare output; and a plurality of purge gas headers, with each of the purge gas headers fluidly coupled to the main header and configured to transport a flow of the purge gas to a flare output through the main header. The method includes, during operation of the flare gas network to output the flare from the plurality of flows of the purge gas, obtaining a fluid pressure of the flow of the purge gas at each purge gas header; obtaining a fluid temperature of the flow of the purge gas at each purge gas header; and obtaining a rate of the flow of the purge gas at each purge gas header; and based on the obtained fluid pressures, fluid temperatures, and rates of the flows of the purge gas, determining an optimized flow velocity of the purge gas at each of the plurality of purge gas headers.

An aspect combinable with the example implementation includes determining corrected rates of flow of the purge gas for the plurality of purge gas headers based on the obtained fluid pressures, the obtained fluid temperatures, and orifice sizes for the plurality of purge gas headers; and determining the optimized flow velocity of the purge gas at each of the plurality of purge gas headers based on the corrected rates of flow of the purge gas for the plurality of purge gas headers.

In another aspect combinable with any of the previous aspects, determining the optimized flow velocity of the purge gas at each of the plurality of purge gas headers includes obtaining a minimum flow velocity of each flow of the purge gas in the plurality of purge gas headers; obtaining a maximum flow velocity of each flow of the purge gas in the plurality of purge gas headers; calculating a flow velocity of each flow of the purge gas in the plurality of purge gas headers based on the corrected rates of flow of the purge gas for the plurality of purge gas headers and a pressure drop through each purge gas header and a size of each purge gas header; comparing the calculated flow velocity of each flow of the purge gas to the obtained minimum and maximum flow velocities of each flow of the purge gas; and based on the comparison, determining the optimized flow velocity of the purge gas at each of the plurality of purge gas headers.

In another aspect combinable with any of the previous aspects, determining the optimized flow velocity of the purge gas at each of the plurality of purge gas headers includes for each calculated flow velocity less than the minimum flow velocity of the flow of the purge gas in the purge gas header, determining an optimized flow velocity for the purge gas in the purge gas header that is between the minimum flow velocity and the maximum flow velocity; and for each calculated flow velocity greater than the maximum flow velocity of the flow of the purge gas in the purge gas header, determining an optimized flow velocity for the purge gas in the purge gas header that is between the minimum flow velocity and the maximum flow velocity.

Another aspect combinable with any of the previous aspects further includes obtaining a measurement of an amount of water in the flow of the purge gas at each purge gas header.

Another aspect combinable with any of the previous aspects further includes determining a composition of each flow of the purge gas at the plurality of purge gas headers; and determining an amount of condensate in each of the plurality of purge gas headers based at least in part on the determined composition of each flow of the purge gas and the measured amount of water in each flow of the purge gas.

Another aspect combinable with any of the previous aspects further includes determining a presence of one or more corrosive species in the determined composition of each flow of the purge gas at the plurality of purge gas headers; and based on the determined presence of one or more corrosive species, determining a estimated corrosion rate of the plurality of purge gas headers.

In another aspect combinable with any of the previous aspects, the one or more corrosive species includes at least one of carbon dioxide ($CO_2$), hydrogen sulfide ($H_2S$), or oxygen ($O_2$).

Another aspect combinable with any of the previous aspects further includes calculating, based on the composition of each flow of the purge gas at the plurality of purge gas headers, a mass flow rate balance of each flow of the purge gas; determining, from the mass flow rate balance of each flow of the purge gas, molar flow rates of each component of each flow of the purge gas; and determining an acidity of each flow of the purge gas based on the molar flow rates of each component.

In another aspect combinable with any of the previous aspects, the flare gas piping network includes a plurality of valves, each valve coupled within a particular purge gas headers, the method including controlling at least one valve to adjust the rate of flow of the purge gas in the particular purge gas header based on the optimized flow velocity of the purge gas in the particular purge gas header.

Implementations of systems and methods for optimizing purge gas flows through a flare gas network according to the present disclosure may also include one or more of the following features. For example, implementations according to the present disclosure can provide cost effective optimization of flare gas systems, as well as reduce combustible fluid losses (in other words, decarbonization) and greenhouse gas emissions. As another example, implementations according to the present disclosure can improve a mass balance (in other words, losses and/or feed percentage) in a flare gas network. Also, implementations according to the present disclosure can ensure or help ensure a minimum required purge gas to avoid air ingress and aid operators to conduct a thorough analysis on the flare gas network in real time basis. As another example, implementations according to the present disclosure can help flare gas network operators can also utilize generated data to adjust and optimize purge gas rates, hence yielding a reduction of greenhouse gas emissions while ensuring flare network integrity.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIG. 3 is a table that shows an example optimized parameter of a flare gas processing system according to the present disclosure.

DETAILED DESCRIPTION

The present disclosure describes example implementations of a flare gas processing system that, for example, can be operated to compute or determine purge gas parameters in processing facilities during the transport of purge gas flows to a flare (in other words, in real-time during operation of the flare gas network). Such purge gas parameters include, for example, one or more of volumetric flow rate, velocity, acidity, molecular weight, and heating value for each purge gas header of a flare gas network. In some aspects, implementations according to the present disclosure can compare measured purge gas flow rates in purge gas headers (also called flare gas headers) to optimum purge gas flow rates defined through historical operation of the network. Real-time data (in other words, data measured or computed during operation of the flare gas network) can be obtained or computed from one or more (and often many) purge gas points in the flare gas network. Real-time data can include, for instance, one or more pressure, temperature, moisture, and flow rate. Implementations according to the present disclosure can include processing the data in conjunction with a heat and material balance of the flare gas network.

In some aspects, the measured or obtained data (in real-time) can be used to determine, for example, flow velocity, kinetic energy, and internal corrosion likelihoods in the purge gas headers of the flare gas network. These determinations can then be processed to optimize, for example, a velocity profile in the flare gas network (for example, a mapping of flow velocities in the purge gas headers in the network) based on optimized flow velocities at the purge gas headers. Based on such determinations, operators of the flare gas network can visualize, for example, unoptimized purge gas headers (or other portions) of the flare gas network, portions of the flare gas network with high internal corrosion risk, and corrective recommendations. Further, based on the determinations, operators can identify both over-purge and under-purge areas to ensure both safe and optimized purge gas flow in the flare gas network. Operators can also identify (based on the determinations) potential in reducing combustible fluid losses due to flaring purge gas (thereby reducing greenhouse gas emissions).

Figure 1:
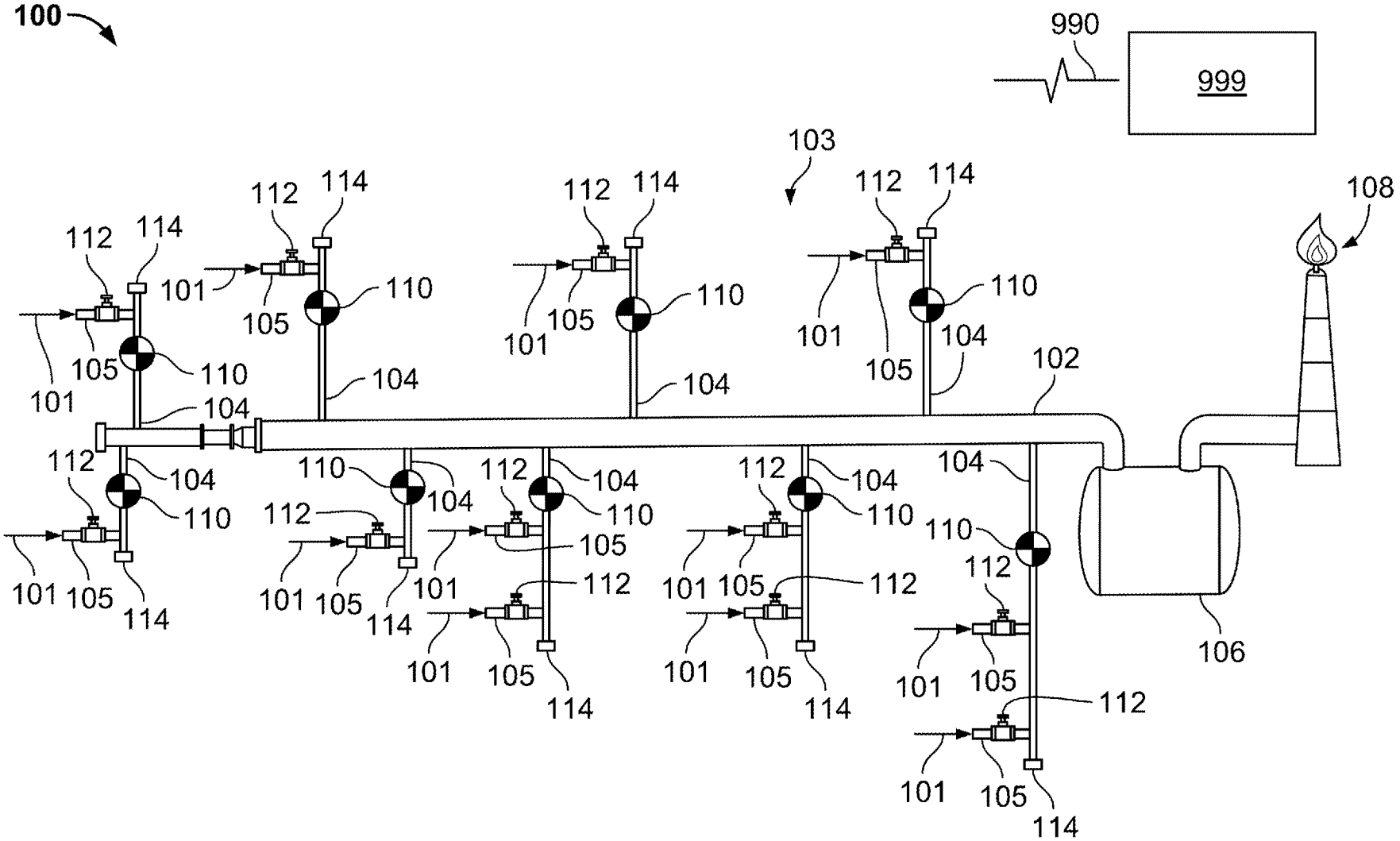
FIG. 1 is a schematic illustration of an example implementation of a flare gas processing system according to the present disclosure.

FIG. 1 is a schematic illustration of an example implementation of a flare gas processing system 100 according to the present disclosure. Flare gas processing system 100 is just an example embodiment of such a system that collects, transports, and/or circulates one or more (and often tens, hundreds, or more) flows of a purge gas 101 through a flare gas network 103 that includes one or more main or primary headers 102 and multiple purge gas headers 104 that are connected to the main header 102. As shown in FIG. 1, the flare gas network 103 includes a flare gas drum 106 to which the flows of purge gas 101 are routed through individual purge gas headers 104 and the main header 102. The flare gas drum 106, which collects the flows of purge gas 101, is fluidly coupled to a flare 108, from which the purge gas 101 can be combusted (resulting in a visible flare). The purge gas 101, in these example implementations, can be comprised of methane (often 80% of the total composition), propane, butane, ethane, other hydrocarbons, inert gases, water or water vapor, and acid gasses (such as oxygen ($O_2$), carbon dioxide ($CO_2$), and/or sulfide acid ($H_2S$), and other sulfur compounds).

Each purge gas header 104 can include multiple components in this example implementation. For example, each flow of the purge gas 101 enters (for example, flows from one or more sources of purge gas) the purge gas header 104 through an opening or orifice 105. A flow measurement assembly 112 is fluidly coupled within the purge gas header 104 and measures or determines a flow rate of the flow of purge gas 101 through the purge gas header 104. Generally, flow measurement assembly 112 can represent a flow meter, an orifice plate, or other flow measurement device (such as a device that calculates flow rate based on differential pressure).

As further shown, each purge gas header 104 includes a sensor assembly 114 that is coupled to the purge gas header 104 to measure or obtain one or more sensed parameters of the flow of the purge gas 101. The sensor assembly 114 can include, for example: a pressure (absolute or differential) sensor to measure a fluid pressure of the flow of the purge gas 101; a temperature sensor to measure a fluid temperature of the flow of the purge gas 101; a moisture sensor to measure an amount or presence of moisture (for example, water or water vapor) within the flow of the purge gas 101; and/or a composition sensor to determine an amount (for example, a molar fraction) of each constituent within the flow of the purge gas 101. Thus, reference to sensor assembly 114 can also be a reference to the pressure (absolute or differential) sensor, temperature sensor, moisture sensor, composition sensor, or a combination thereof.

In example implementations, the purge gas header 104 a valve 110 that can be operated to control a rate of flow of the flow of purge gas 101 through the purge gas header 104 (and to the main header 102). Although shown as a single valve 110 in each purge gas header 104, valve 110 can represent multiple valves (for example, shutoff, modulating, or a combination thereof) that can be operated in concert to control the rate of flow of the flow of purge gas 101 through the purge gas header 104.

Taken in aggregate, the flare gas processing system 100 includes multiple flows of the purge gas 101 (with one or more of the flows being identical in composition or varying in composition) that are transported, during operation of the flare gas network 103, through respective purge gas headers 104 to the main header 102. Combined in the main header 102, the flows of purge gas 101 are transported to the flare gas drum 106 and then to (or directly to) the flare 108 for disposal through combustion. During transport, the system 100 operates to measure, identify, and/or obtain data related to each flow of the purge gas 101 through the respective purge gas headers 104. For example, for each flow of the purge gas 101, temperature, pressure (absolute or differential), flow rate, moisture content, and constituent composition (or some combination of these parameters less than all of them) can be measured or obtained (for example, by or with or through the sensor assembly 114 and flow measurement assembly 112).

As shown in FIG. 1, the flare gas processing system 100 includes a control system 999. The control system 999 can be a processor-based control system or any other system operable to communicate with, receive data from, or provide commands to, one or more components of the flare gas processing system 100. In some example, the control system 999 can be a hydraulic control system, pneumatic control system, electro-mechanical control system, electronic and processor-based control system, or a combination thereof. Control system 999 communicates through signals 990, which can be wireless, wired, or a combination thereof. Signals 990 can represent measured data by the flow measurement assembly 112 and/or the sensor assembly 114 to the control system 999 (for example, flow rates of the flows of the purge gas 101, temperatures of the flows of the purge gas 101, pressures of the flows of the purge gas 101, moisture content of the flows of the purge gas 101, and content of the flows of the purge gas 101). Signals 990 can also represent commands from the control system 999 to, for example, the valves 110.

Figure 2:
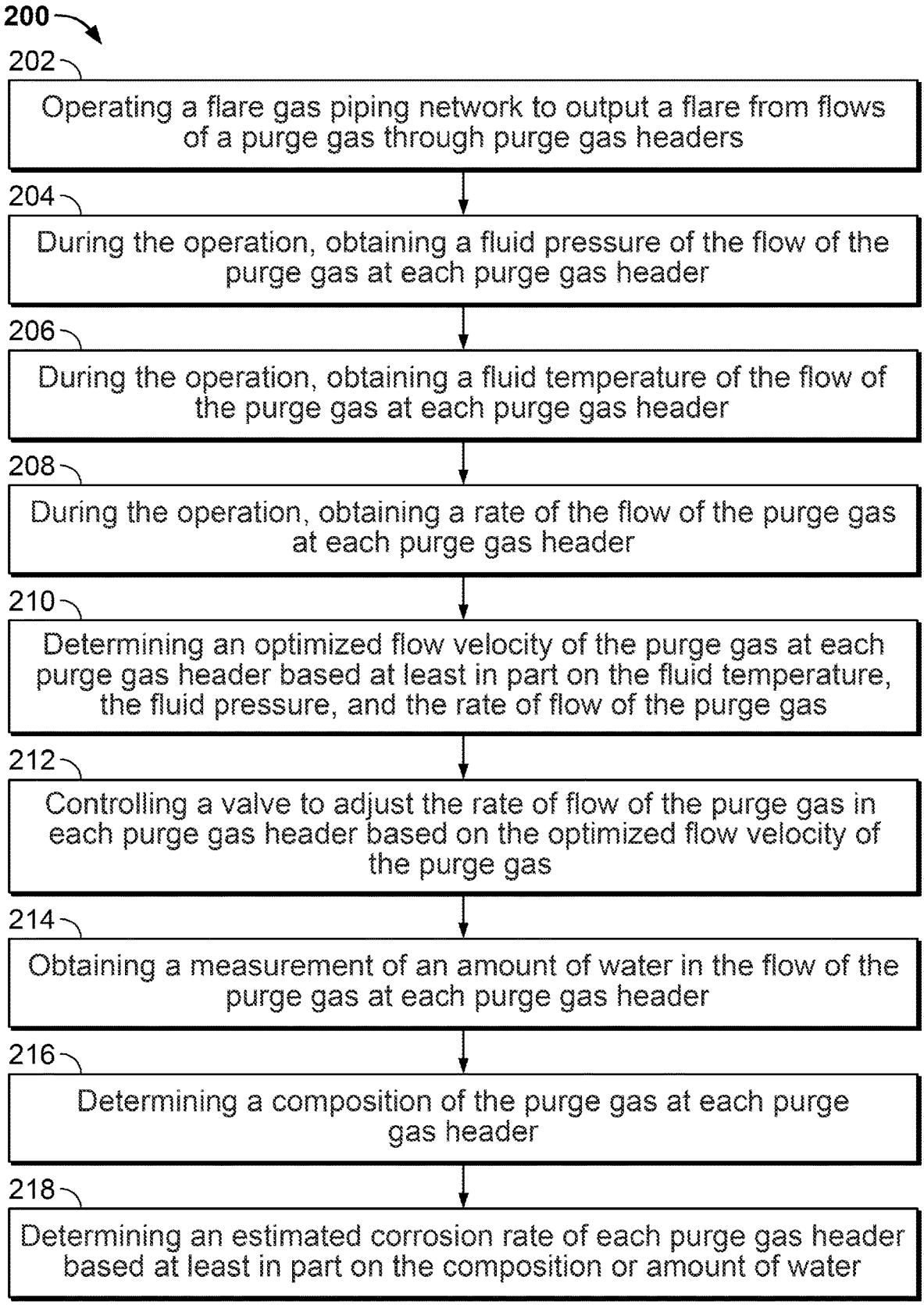
FIG. 2 is a flowchart that illustrates an example method of processing flare gas according to the present disclosure.

FIG. 2 is a flowchart that illustrates an example method 200 of processing flare gas according to the present disclosure. In some aspects, method 200 can be performed with or by the flare gas processing system 100 and, more particularly, one, some, or all of the steps can be performed with or by the control system 999. Method 200 can begin at step 202, which includes operating a flare gas piping network to output a flare from flows of a purge gas through purge gas headers. For example, flare gas processing system 100, and more particularly the flare gas network 103, can operated to transport flows of purge gas 101 through purge gas headers 104 (in some cases, with each flow of purge gas 101 transported from a separate source of purge gas 101 through a unique purge gas header 104) to the main header 102. The combined flows of purge gas 101 in main header 102 can be transported to the flare 108 (optionally through flare gas drum 106) for disposal to the atmosphere.

Method 200 can continue at step 204, which includes, during the operation, obtaining a fluid pressure of the flow of the purge gas at each purge gas header. For example, as each (or one or more) purge gas header 104 transports a particular flow of purge gas 101 to the main header 102, the sensor assembly 114, including a pressure sensor (absolute or differential), in that header 104 can measure the fluid pressure of the purge gas 101 in the respective purge gas header 104. The measured fluid pressure data can be transmitted to the control system 999 through signals 990 (or otherwise obtained, in real-time, by the control system 999). Thus, in step 204, multiple fluid pressures (for instance, one per purge gas header 104) can be measured and obtained by the control system 999 (and stored, at least transiently).

Method 200 can continue at step 206, which includes, during the operation, obtaining a fluid temperature of the flow of the purge gas at each purge gas header. For example, as each (or one or more) purge gas header 104 transports a particular flow of purge gas 101 to the main header 102, the sensor assembly 114, including a temperature sensor, in that header 104 can measure the fluid pressure of the purge gas 101 in the respective purge gas header 104. The measured fluid temperature data can be transmitted to the control system 999 through signals 990 (or otherwise obtained, in real-time, by the control system 999). Thus, in step 206, multiple fluid temperatures (for instance, one per purge gas header 104) can be measured and obtained by the control system 999 (and stored, at least transiently).

Method 200 can continue at step 208, which includes, during the operation, obtaining a rate of the flow of the purge gas at each purge gas header. For example, as each (or one or more) purge gas header 104 transports a particular flow of purge gas 101 to the main header 102, the flow measurement assembly 112 in that header 104 can measure the rate of flow of the purge gas 101 in the respective purge gas header 104. The measured flow rate data can be transmitted to the control system 999 through signals 990 (or otherwise obtained, in real-time, by the control system 999). Thus, in step 208, multiple flow rates (for instance, one per purge gas header 104) can be measured and obtained by the control system 999 (and stored, at least transiently).

Method 200 can continue at step 210, which includes determining an optimized flow velocity of the purge gas at each purge gas header based at least in part on the fluid temperature, the fluid pressure, and the rate of flow of the purge gas. For example, in some aspects, based on the measured flow rates and known sizes of the orifices 105 (stored, for example, in the control system 999), flow velocities of the purge gas 101 (through each purge gas header 104) can be determined and optimized flow velocities of the purge gas 101 can be calculated.

In some aspects, the measured flow rates (or flow rates calculated according to a measured pressure drop through the purge gas headers 104) can be corrected or compensated according to the measured temperatures and pressures. For example, measure or calculated (according to pressure drop) flow rates may not be completely accurate of not compensated according to the measured fluid temperature and fluid pressure of the purge gas 101 that flows through each purge gas header 104. Compensated flow rates can be determined, for example, by the control system 999, according to:

$$\text{Flow}_{compensated} = \text{Flow}_C\sqrt{\frac{P_m}{T_m}}, \qquad \text{Eq. 1}$$

where $\text{Flow}_c$ is the calculated or measured flow rate of the purge gas 101 through each purge gas header 104, $P_m$ is the measured fluid pressure of the flow of the purge gas 101 through each purge gas header 104, and $T_m$ is the measured fluid pressure of the flow of the purge gas 101 through each purge gas header 104. The compensated flow rates, along with respective orifice sizes, can then be used to determine an optimized flow velocity of the purge gas 101 at each purge gas header 104.

In some aspects, an optimized velocity of a flow of purge gas 101 is between a minimum velocity of the flow and a maximum velocity of the flow. In some aspects, the minimum and maximum flow velocities of the purge gas 101 can be set according to flare gas network standards to, for example, prevent or reduce corrosion, moisture build up, and safety considerations. Minimum and maximum flow velocities can also be determined, for example, according to orifice or pipe sizes of each purge gas header 104 and can be stored in the control system 999.

The calculated flow velocities for the flows of purge gas 101 can be compared against the minimum and maximum velocities (for each purge gas header 104). If the calculated flow velocity is less than the minimum for a particular purge gas header 104, an optimized flow velocity can be set, for example, by and in the control system 999, as a value greater than the minimum flow velocity but less than the maximum flow velocity (for that particular purge gas header 104). If the calculated flow velocity is greater than the maximum for another particular purge gas header 104, an optimized flow velocity can be set, for example, by and in the control system 999, as a value less than the maximum flow velocity but greater than the minimum flow velocity (for that particular purge gas header 104).

For example, FIG. 3 is a table 300 that shows an example optimized parameter of a flare gas processing system according to the present disclosure. Here, while optimized values of volumetric flow rates for a number of purge gas headers are shown, according to step 210, optimized flow velocities can also be used. As shown in table 300, column 302 shows a number of purge gas headers (styled, "manifolds" in this table) within an example flare gas network. For each purge gas header labeled 1 through 7, an actual volumetric flow rate is shown in column 304. This actual (or measured) volumetric flow rate can be determined based on the measured or calculated flow velocity for these purge gas headers and a known flow area (for example, according to a known diameter) of each purge gas header in column 302. Subsequent to step 210 in method 200, optimized values of the volumetric flow rates at each purge gas headers are determined and are shown in column 304. As shown, some optimized values are greater than the actual values, while some optimized values are less than the actual values.

Method 200 can continue at step 212, which includes controlling a valve to adjust the rate of flow of the purge gas in each purge gas header based on the optimized flow velocity of the purge gas. For example, subsequent to step 210 in which optimized flow velocities of the flows of purge gas 101 through purge gas headers 104 are determined, the control system 999 can operate one or more valves 110 to modulate the flow(s) of the purge gas 101 to meet the optimized flow velocities (or volumetric flow rates in examples where that parameter is optimized).

Method 200 can continue at step 214, which includes obtaining a measurement of an amount of water in the flow of the purge gas at each purge gas header. For example, in some aspects, the sensor assembly 114 includes a moisture sensor, which can measure an amount of water or water vapor (in other words, condensate) in the flows of purge gas 101. Step 214 can also include conducting a flow assurance study based on the amount of measured condensate, flow velocities of the flows of purge gas 101, and the layout of the flare gas network 103 to find a minimum sweeping velocity.

Method 200 can continue at step 216, which includes determining a composition of the purge gas at each purge gas header. For example, a mass balance for each purge gas header 104 can be determined by the control system 999 starting from each purge gas source to the header in the flare gas network 103) according to:

$$N_i = \sum_{i=1}^{n} (Xi_i \times V_i + Xi_2 \times V_2 + \ldots + Xi_n \times V_n)/C, \qquad \text{Eq. 2}$$

where Ni is a total molar flow of component (i) at each purge gas header in (lb_mol/d), V is a volumetric flow rate of a flow of purge gas 101 at each purge gas header (in mmscfd), Xi is a mole fraction of component (i) in the flow of purge gas, and C is a constant equal to 379.3 scf/lbmole and is the standard molar volume at 14.7 pounds per square inch (psia) and 60 degrees Fahrenheit (° F.). Based on step 216, the constituent components of each flow of purge gas 101 can be determined, which, in some cases, can include corrosive species such as $CO_2$, $H_2S$, $O_2$, and others.

Method 200 can continue at step 218, which includes determining an estimated corrosion rate of each purge gas header based at least in part on the composition or amount of water. For example, once the constituent components are determined in step 216, including corrosive species, the control system 999 can estimate corrosion rates based on the presence and amount of such corrosive species.

Figure 4:
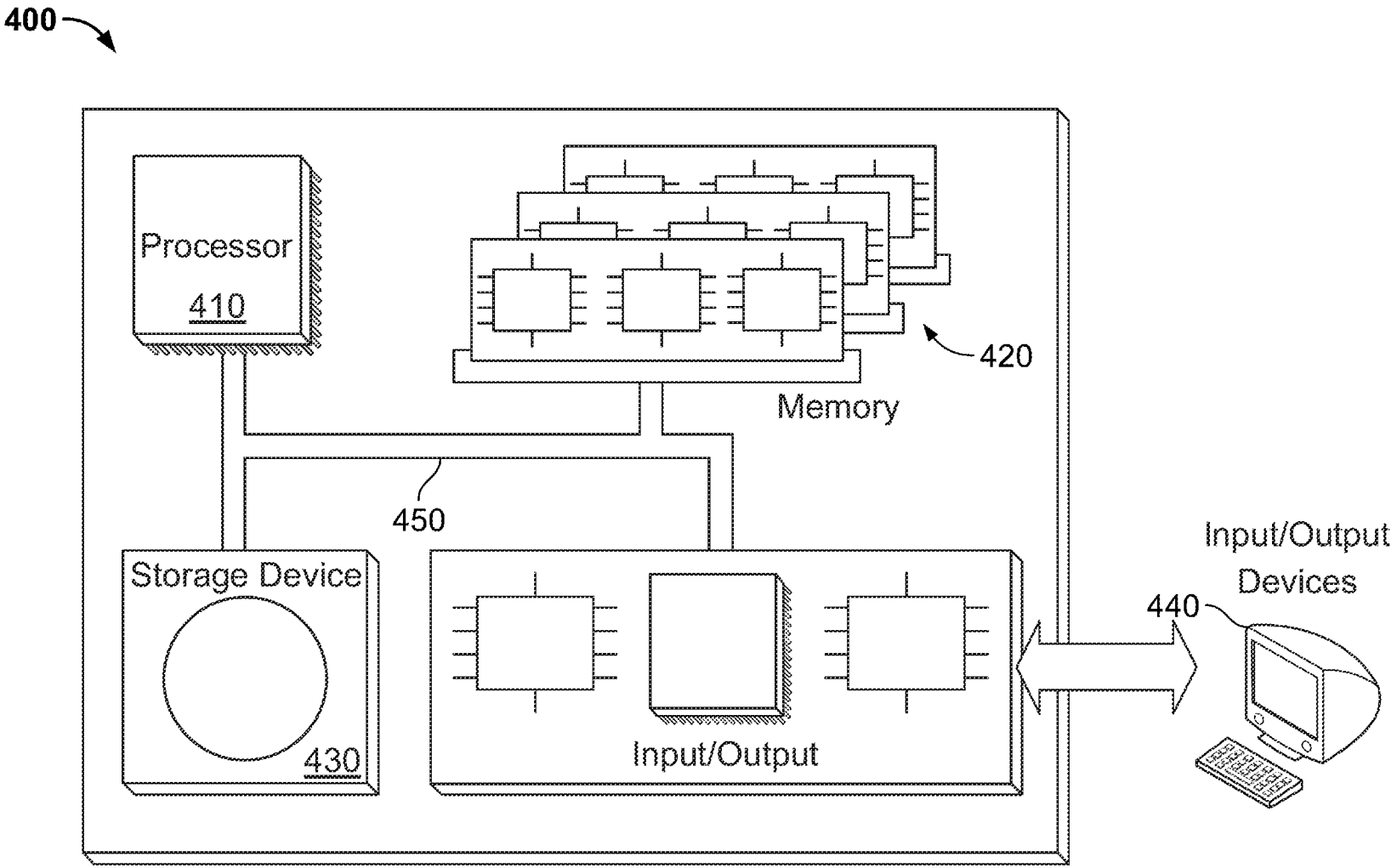
FIG. 4 is a schematic illustration of a controller or control system for a flare gas processing system according to the present disclosure.

FIG. 4 is a schematic illustration of an example controller 400 (or control system) for a flare gas processing system. For example, the controller 400 can be used for the operations described previously, for example as or as part of the control system 999. For example, the controller 400 may be communicably coupled with, or as a part of, a flare gas processing system as described herein.

The controller 400 is intended to include various forms of digital computers, such as printed circuit boards (PCB), processors, digital circuitry, or otherwise that is part of a vehicle. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 400 includes a processor 410, a memory 420, a storage device 430, and an input/output device 440. Each of the components 410, 420, 430, and 440 are interconnected using a system bus 450. The processor 410 is capable of processing instructions for execution within the controller 400. The processor may be designed using any of a number of architectures. For example, the processor 410 may be a CISC (Complex Instruction Set Computers) processor, a RISC (Reduced Instruction Set Computer) processor, or a MISC (Minimal Instruction Set Computer) processor.

In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the controller 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the controller 400. In one implementation, the storage device 430 is a computer-readable medium. In various different implementations, the storage device 430 may be a floppy disk device, a hard disk device, an optical disk device, a tape device, flash memory, a solid state device (SSD), or a combination thereof.

The input/output device 440 provides input/output operations for the controller 400. In one implementation, the input/output device 440 includes a keyboard and/or pointing device. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A flare gas processing system, comprising:

a flare gas piping network, comprising:

a main header fluidly coupled to a flare output; and a plurality of purge gas headers, each of the purge gas headers fluidly coupled to the main header and configured to receive a flow of a purge gas;

a pressure sensor coupled to each purge gas header and configured to measure a fluid pressure of the flow of the purge gas at each purge gas header;

a temperature sensor coupled to each purge gas header and configured to measure a fluid temperature of the flow of the purge gas at each purge gas header;

a flow measurement assembly coupled to each purge gas header and configured to measure a rate of the flow of the purge gas at each purge gas header; and a control system communicably coupled to the pressure sensors, the temperature sensors, and the flow measurement assemblies and configured to perform operations, comprising:

during the flows of the purge gas through the plurality of purge gas headers, obtaining the fluid pressures, the fluid temperatures, and the rates of the flows of the purge gas; and based on the obtained fluid pressures, fluid temperatures, and rates of the flows of the purge gas, determining an optimized flow velocity of the purge gas at each of the plurality of purge gas headers.

2. The flare gas processing system of claim 1, wherein the operations comprise:

determining corrected rates of flow of the purge gas for the plurality of purge gas headers based on the obtained fluid pressures, the obtained fluid temperatures, and orifice sizes for the plurality of purge gas headers; and determining the optimized flow velocity of the purge gas at each of the plurality of purge gas headers based on the corrected rates of flow of the purge gas for the plurality of purge gas headers.

3. The flare gas processing system of claim 2, wherein the operation of determining the optimized flow velocity of the purge gas at each of the plurality of purge gas headers comprises:

obtaining a minimum flow velocity of each flow of the purge gas in the plurality of purge gas headers;

obtaining a maximum flow velocity of each flow of the purge gas in the plurality of purge gas headers;

calculating a flow velocity of each flow of the purge gas in the plurality of purge gas headers based on the corrected rates of flow of the purge gas for the plurality of purge gas headers and a pressure drop through each purge gas header and a size of each purge gas header;

comparing the calculated flow velocity of each flow of the purge gas to the obtained minimum and maximum flow velocities of each flow of the purge gas; and based on the comparison, determining the optimized flow velocity of the purge gas at each of the plurality of purge gas headers.

4. The flare gas processing system of claim 3, wherein determining the optimized flow velocity of the purge gas at each of the plurality of purge gas headers comprises:

for each calculated flow velocity less than the minimum flow velocity of the flow of the purge gas in the purge gas header, determining the optimized flow velocity for the purge gas in the purge gas header that is between the minimum flow velocity and the maximum flow velocity; and for each calculated flow velocity greater than the maximum flow velocity of the flow of the purge gas in the purge gas header, determining the optimized flow velocity for the purge gas in the purge gas header that is between the minimum flow velocity and the maximum flow velocity.

5. The flare gas processing system of claim 1, further comprising:

a moisture sensor coupled to each purge gas header and configured to measure an amount of water in the flow of the purge gas at each purge gas header.

6. The flare gas processing system of claim 5, wherein the operations comprise:

determining a composition of each flow of the purge gas at the plurality of purge gas headers; and determining an amount of condensate in each of the plurality of purge gas headers based at least in part on the determined composition of each flow of the purge gas and the measured amount of water in each flow of the purge gas.

7. The flare gas processing system of claim 6, wherein the operations comprise:

determining a presence of one or more corrosive species in the determined composition of each flow of the purge gas at the plurality of purge gas headers; and based on the determined presence of one or more corrosive species, determining a estimated corrosion rate of the plurality of purge gas headers.

8. The flare gas processing system of claim 7, wherein the one or more corrosive species comprises at least one of carbon dioxide ($CO_2$), hydrogen sulfide ($H_2S$), or oxygen ($O_2$).

9. The flare gas processing system of claim 6, wherein the operations comprise:

calculating, based on the composition of each flow of the purge gas at the plurality of purge gas headers, a mass flow rate balance of each flow of the purge gas;

determining, from the mass flow rate balance of each flow of the purge gas, molar flow rates of each component of each flow of the purge gas; and determining an acidity of each flow of the purge gas based on the molar flow rates of each component.

10. The flare gas processing system of claim 1, further comprising a plurality of valves, each valve coupled within a particular purge gas headers and configured to control the flow of the purge gas in the particular purge gas header, the operations comprising:

controlling at least one valve to adjust the rate of flow of the purge gas in the particular purge gas header based on the optimized flow velocity of the purge gas in the particular purge gas header.

11. A method of processing a flare gas, comprising:

operating a flare gas piping network to output a flare from a plurality of flows of a purge gas, the flare gas piping network comprising:

a main header fluidly coupled to a flare output; and a plurality of purge gas headers, each of the purge gas headers fluidly coupled to the main header and configured to transport a flow of the purge gas to a flare output through the main header; and during operation of the flare gas network to output the flare from the plurality of flows of the purge gas:

obtaining a fluid pressure of the flow of the purge gas at each purge gas header;

obtaining a fluid temperature of the flow of the purge gas at each purge gas header;

obtaining a rate of the flow of the purge gas at each purge gas header; and based on the obtained fluid pressures, fluid temperatures, and rates of the flows of the purge gas, determining an optimized flow velocity of the purge gas at each of the plurality of purge gas headers.

12. The method of claim 11, further comprising:

determining corrected rates of flow of the purge gas for the plurality of purge gas headers based on the obtained fluid pressures, the obtained fluid temperatures, and orifice sizes for the plurality of purge gas headers; and determining the optimized flow velocity of the purge gas at each of the plurality of purge gas headers based on the corrected rates of flow of the purge gas for the plurality of purge gas headers.

13. The method of claim 12, wherein determining the optimized flow velocity of the purge gas at each of the plurality of purge gas headers comprises:

obtaining a minimum flow velocity of each flow of the purge gas in the plurality of purge gas headers;

obtaining a maximum flow velocity of each flow of the purge gas in the plurality of purge gas headers;

calculating a flow velocity of each flow of the purge gas in the plurality of purge gas headers based on the corrected rates of flow of the purge gas for the plurality of purge gas headers and a pressure drop through each purge gas header and a size of each purge gas header;

comparing the calculated flow velocity of each flow of the purge gas to the obtained minimum and maximum flow velocities of each flow of the purge gas; and based on the comparison, determining the optimized flow velocity of the purge gas at each of the plurality of purge gas headers.

14. The method of claim 13, wherein determining the optimized flow velocity of the purge gas at each of the plurality of purge gas headers comprises:

for each calculated flow velocity less than the minimum flow velocity of the flow of the purge gas in the purge gas header, determining an optimized flow velocity for the purge gas in the purge gas header that is between the minimum flow velocity and the maximum flow velocity; and for each calculated flow velocity greater than the maximum flow velocity of the flow of the purge gas in the purge gas header, determining an optimized flow velocity for the purge gas in the purge gas header that is between the minimum flow velocity and the maximum flow velocity.

15. The method of claim 11, further comprising obtaining a measurement of an amount of water in the flow of the purge gas at each purge gas header.

16. The method of claim 15, further comprising:

determining a composition of each flow of the purge gas at the plurality of purge gas headers; and determining an amount of condensate in each of the plurality of purge gas headers based at least in part on the determined composition of each flow of the purge gas and the measured amount of water in each flow of the purge gas.

17. The method of claim 16, further comprising:

determining a presence of one or more corrosive species in the determined composition of each flow of the purge gas at the plurality of purge gas headers; and based on the determined presence of one or more corrosive species, determining a estimated corrosion rate of the plurality of purge gas headers.

18. The method of claim 17, wherein the one or more corrosive species comprises at least one of carbon dioxide ($CO_2$), hydrogen sulfide ($H_2S$), or oxygen ($O_2$).

19. The method of claim 16, further comprising:

calculating, based on the composition of each flow of the purge gas at the plurality of purge gas headers, a mass flow rate balance of each flow of the purge gas;

determining, from the mass flow rate balance of each flow of the purge gas, molar flow rates of each component of each flow of the purge gas; and determining an acidity of each flow of the purge gas based on the molar flow rates of each component.

20. The method of claim 11, wherein the flare gas piping network comprises a plurality of valves, each valve coupled within a particular purge gas headers, the method comprising:

controlling at least one valve to adjust the rate of flow of the purge gas in the particular purge gas header based on the optimized flow velocity of the purge gas in the particular purge gas header.

* * * * *